US006533707B2

(12) United States Patent
Wang et al.

(10) Patent No.: US 6,533,707 B2
(45) Date of Patent: Mar. 18, 2003

(54) FOLDING MECHANISM FOR AN EXERCISE TREADMILL

(76) Inventors: Leao Wang, No. 1, Lane 233, Sec. 2, Charng Long Rd., Taiping (TW), 411; Peter Wu, No. 1, Lane 233, Sec. 2, Charng Long Rd., Taiping (TW), 411

( * ) Notice: Subject to any disclaimer, the term of this patent is extended or adjusted under 35 U.S.C. 154(b) by 27 days.

(21) Appl. No.: 09/861,512

(22) Filed: May 21, 2001

(65) Prior Publication Data

US 2002/0173408 A1 Nov. 21, 2002

(51) Int. Cl.[7] ..... A63B 22/02
(52) U.S. Cl. ..... 482/54; 482/72
(58) Field of Search ..... 482/148, 54, 72

(56) References Cited

U.S. PATENT DOCUMENTS 3,731,917 A * 5/1973 Townsend ..... 272/69
5,674,453 A * 10/1997 Watterson et al. ..... 482/54
6,033,347 A * 3/2000 Daleabout et al. ..... 482/54
6,077,200 A * 6/2000 Lin ..... 482/54
6,273,842 B1 * 8/2001 Wang et al. ..... 482/54

* cited by examiner

*Primary Examiner*—Nicholas D. Lucchesi
*Assistant Examiner*—Lori Baker Amerson
(74) *Attorney, Agent, or Firm*—Kuo-Hsiung Chiu; Troxell Law Office PLLC.

(57) ABSTRACT

The present invention relates to a folding mechanism for an exercise treadmill having a U-shaped handrail, each end of the U-shaped handrail is pivotably connected to a vertical part of the supporting arm by a second pivot. A connection rod extends downwards from either side of the U-shaped handrail, and is pivotally connected to a pull rod by a third pivot. An end of each of the pull rods is pivotably secured to the corresponding position of the frame by a fourth pivot. Accordingly, when the U-shaped handrail is raised and turned on the second pivot, the connection rod will also be moved to bring the pull rod to shift upwards. Thereafter, the frame is turned on the first pivot to be raised to the top for completing the folding step of the frame.

1 Claim, 4 Drawing Sheets

FOLDING MECHANISM FOR AN EXERCISE TREADMILL

BACKGROUND OF THE INVENTION

1. Field of the Invention

The present invention relates to a folding mechanism for an exercise treadmill, and more particularly, an exercise treadmill whose frame can be folded or unfolded by moving the handrail. Therefore, the using convenience and safety is ensured.

2. Description of the Prior Art

The frame of the conventional treadmill (for example, the disclosed U.S. Pat. Nos. 5,674,453, and 6,033,347) is designed to be foldable in order to reduce the occupied space and facilitate the movement thereof. However, these products have to include an auxiliary lifting member (like pneumatic or oil-pressurized cylinder) behind the frame in order to prevent the frame from an unexpected collapse endangering the operator or the others around. Accordingly, the whole design and use show much inconvenience.

Moreover, this conventional design doesn't fit the old or the disabled because they have much difficulty in bending down to perform the folding movement.

SUMMARY OF THE INVENTION

It is a primary object of the present invention to remove the above-mentioned drawbacks and to provide a folding mechanism for an exercise treadmill through which the operator doesn't need to bend down to perform the folding movement of the frame. Furthermore, the frame can be folded to the top at an automatic locking position by means of components of connection rods, pull rods and corresponding pivots for achieving a full safety for operators and people around.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
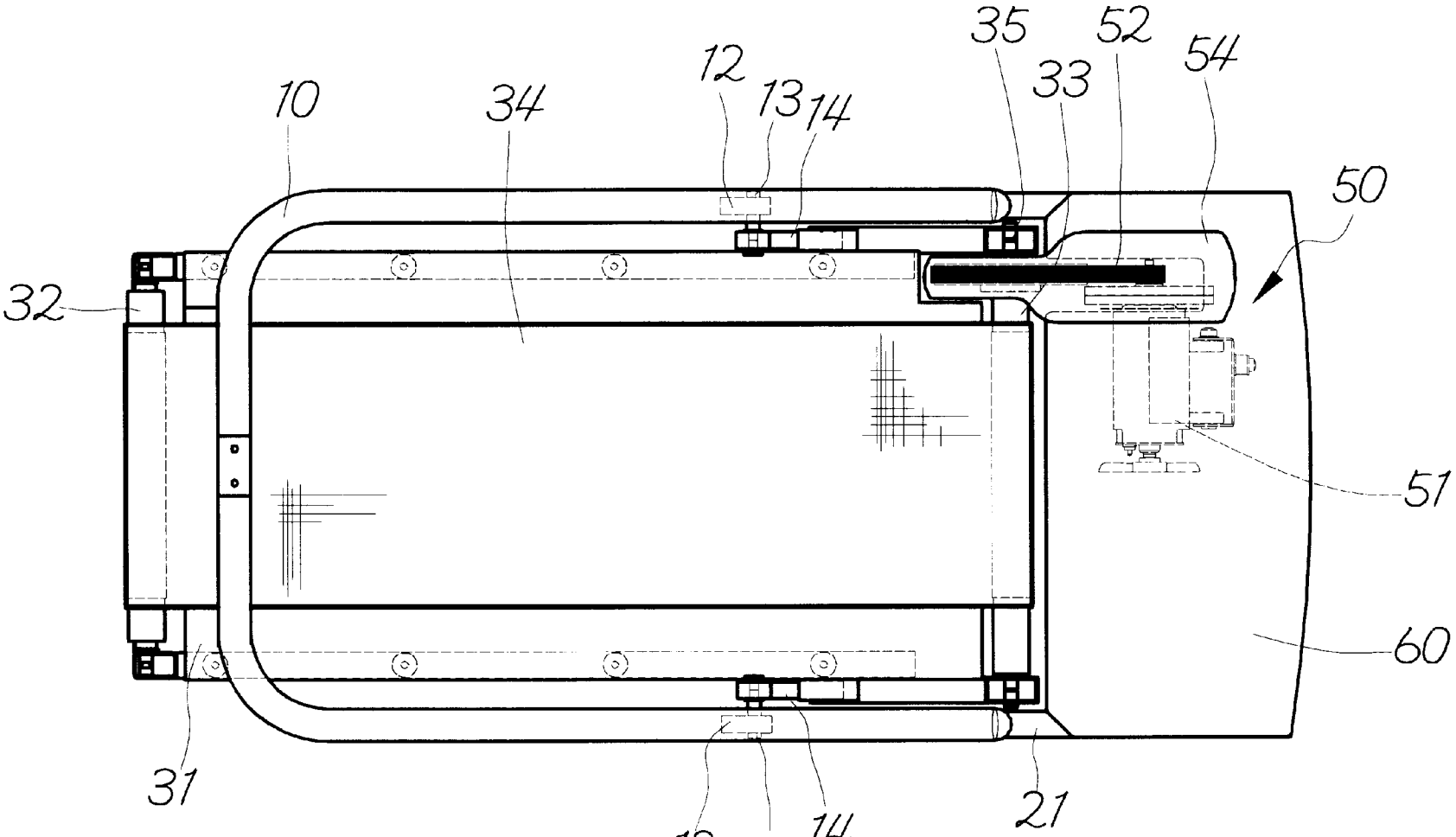
FIG. 1 is a top view of the present invention.
Figure 2:
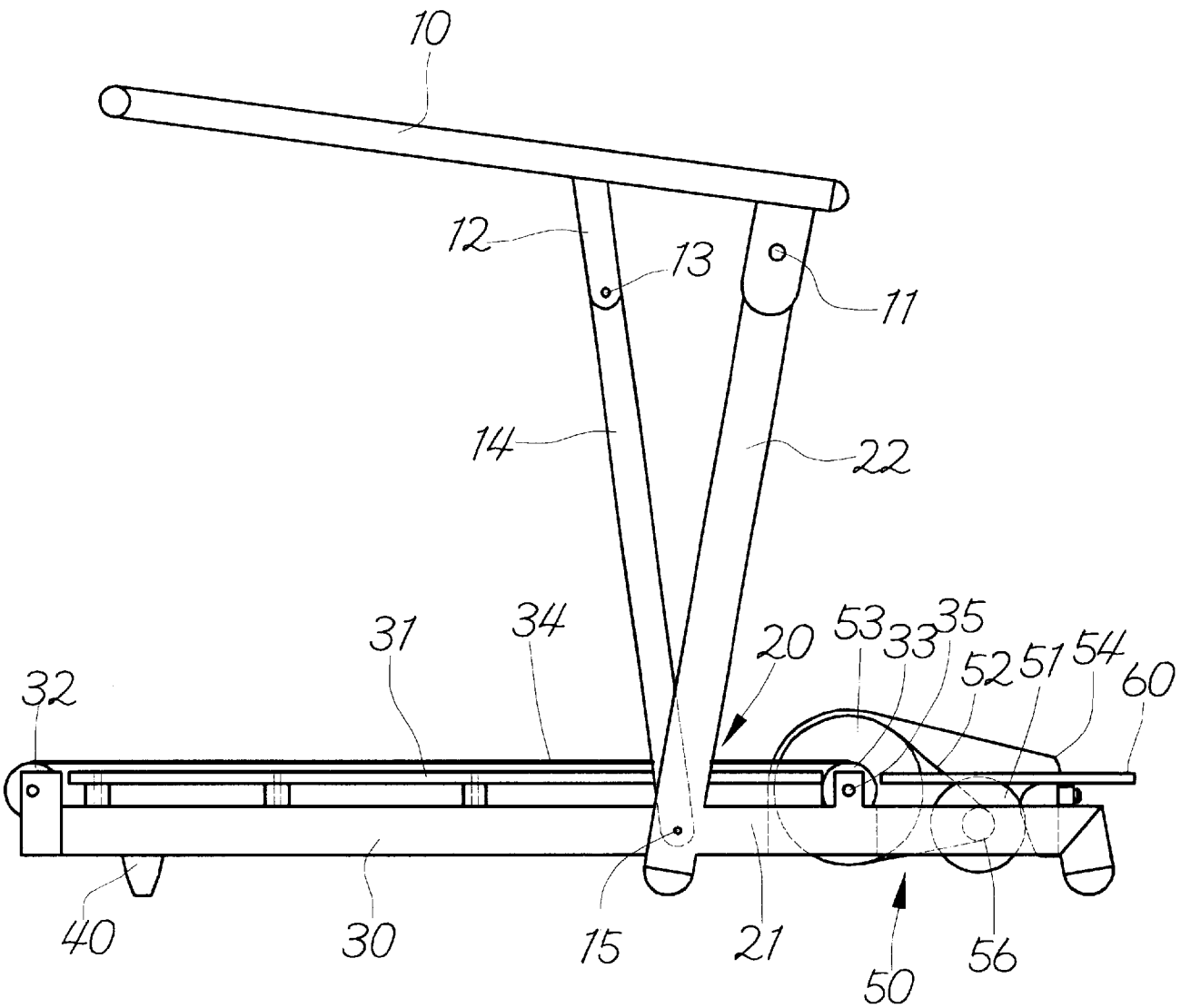
FIG. 2 is a side view of the present invention.

First of all, referring to FIGS. 1 and 2, a preferred embodiment of the present invention mainly includes a U-shaped handrail 10, two supporting arms 20, a frame 30, a front support 40, a motorized assembly 50 and a rear treading plate 60. The frame 30 has a platform 31 the front and rear ends of which are fitted with a front and rear rollers 32, 33 between which a treadmill walking belt 34 circles. Besides, the rear roller 33 of the frame 30 is positioned on horizontal parts 21 of the supporting arms 20 by means of a first pivot 35.

The motorized assembly 50 comprises a motor 51, a belt 52, a driven wheel 53 and a protection cover 54. The motor 51 is fixed behind the horizontal parts 21 of the supporting arms 20 by means of a fastening member. The belt extends between a power output shaft 56 and the driven wheel 53 while the rear roller 33 is driven by the driven wheel 53 for a rotational movement of the treadmill walking belt 34.

Each end of the U-shaped handrail 10 is pivotably connected to a vertical part 22 of two supporting arms 20 by means of a second pivot 11. A connection rod 12 extends downwards from either side of the U-shaped handrail 10, and each of the connection rod 12 is pivotally connected to a pull rod 14 by means of a third pivot 13. Thereafter, the other end of each of the pull rods 14 is pivotably secured to the corresponding position of the frame 30 by means of a fourth pivot 15. Therefore, when the U-shaped handrail 10 is raised and turned on the second pivot 11, the connection rod 12 will also be moved to bring the pull rod 14 to shift upwards. Thereafter, the frame 30 is turned on the first pivot 35 to be raised to the top for completing the folding step of the frame 30.

Figure 3:
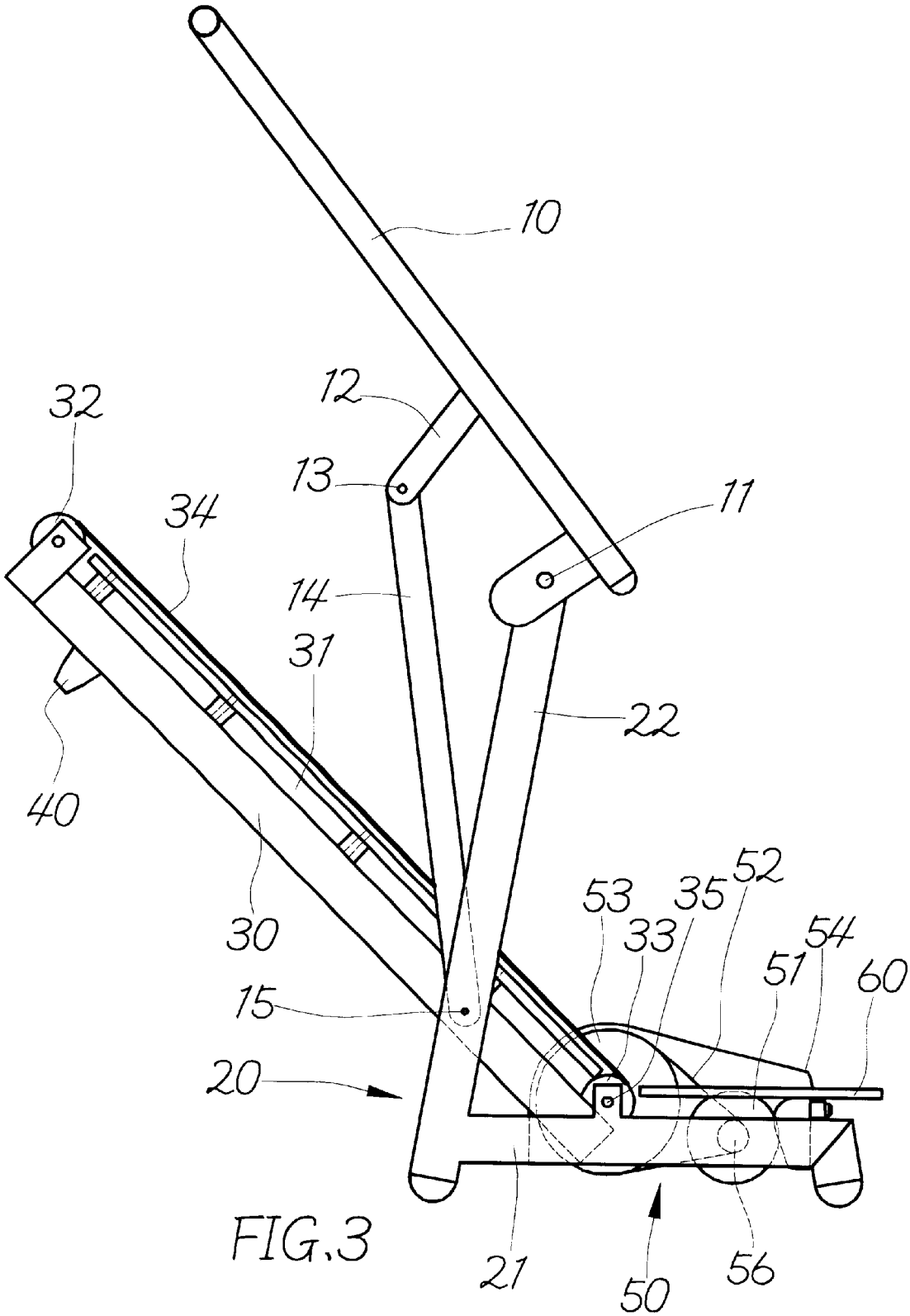
FIG. 3 is a side view of the present invention showing the action thereof.
Figure 4:
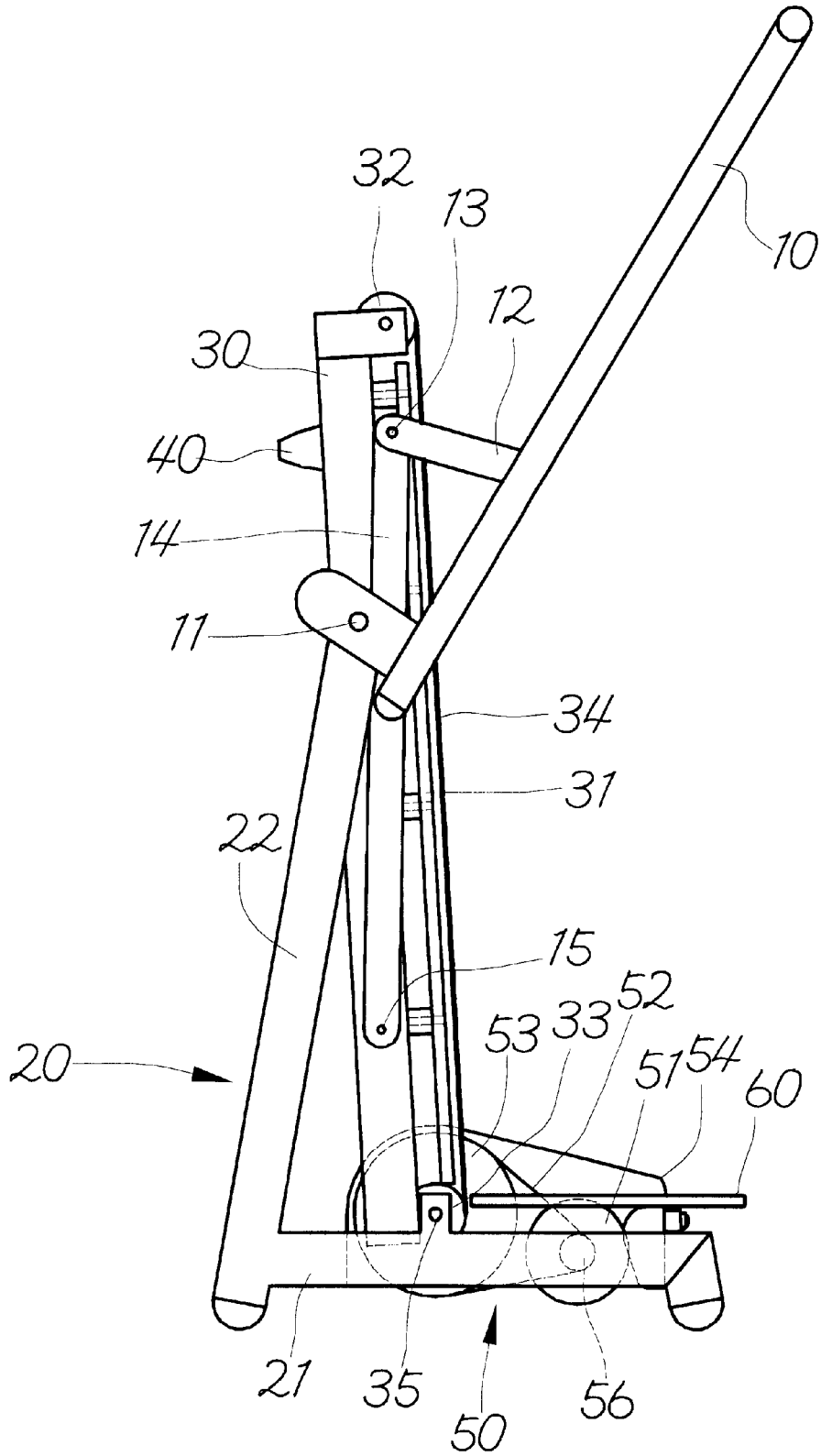
FIG. 4 is another side view of the present invention showing the action thereof.

Based on the above-mentioned components, as shown in FIGS. 3 and 4, the frame 30 can be folded for storage or unfolded for exercise operation only by moving the U-shaped handrail 10. Meanwhile, when the U-shaped handrail 10 is moved up to the top (see FIG. 4), the connection rod 12 and the pull rod 14 will create a blocking angle at which the frame 30 won't be unexpectedly collapsed even in case of being moved. The frame 30 can only be lowered by moving the U-shaped handrail 10 in proper operation steps so that the safety is more ensured.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A folding mechanism for an exercise treadmill comprising a U-shaped handrail, two supporting arms, a frame, a front support, a motorized assembly and a rear treading plate;

wherein the improvement is characterized by:

said frame having a platform, the front and rear ends of said platform which are fitted with a front and rear rollers between which a treadmill walking belt circles, said rear roller of said frame being positioned on horizontal parts of said supporting arms by a first pivot;

said motorized assembly having a motor, a belt, a driven wheel and a protection cover, said motor being fixed behind said horizontal parts of said supporting arms by a fastening member, said belt extending between a power output shaft and said driven wheel while said rear roller is driven by said driven wheel for a rotational movement of said treadmill walking belt; and each end of said U-shaped handrail being pivotably connected to a vertical part of said supporting arms by a second pivot, a connection rod extending downwards from either side of said U-shaped handrail, each of said connection rod being pivotally connected to a pull rod by a third pivot, the other end of each of said pull rods being pivotably secured to the corresponding position of said frame by a fourth pivot so that when said U-shaped handrail is raised and turned on said second pivot, said connection rod will also be moved to bring said pull rod to shift upwards, whereupon said frame is turned on said first pivot to be raised to the top for completing the folding step of said frame.

* * * * *